US012078458B1

(12) United States Patent
Rackers et al.

(10) Patent No.: US 12,078,458 B1
(45) Date of Patent: Sep. 3, 2024

(54) FIN DEPLOYMENT SYSTEM FOR A PROJECTILE, PROJECTILE, AND METHOD OF DEPLOYING A FIN ON A PROJECTILE

(71) Applicant: The Boeing Company, Arlington, VA (US)

(72) Inventors: Keith G. Rackers, Florissant, MO (US); David T. Fischer, St. Charles, MO (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 18/297,171

(22) Filed: Apr. 7, 2023

(51) Int. Cl.
*F42B 10/16* (2006.01)

(52) U.S. Cl.
CPC ..... *F42B 10/16* (2013.01)

(58) Field of Classification Search
CPC ..... F42B 10/16; F42B 10/02; F42B 10/18; F42B 10/26; F42B 10/12; F42B 10/14
See application file for complete search history.

(56) References Cited

U.S. PATENT DOCUMENTS 4,232,843 A * 11/1980 Clark ..... F02K 9/974 244/3.29
4,778,127 A * 10/1988 Duchesneau ..... F42B 10/16 D22/100
6,978,967 B1 * 12/2005 Scheper ..... F42B 10/16 102/385
7,681,503 B1 * 3/2010 Fridley, Jr. ..... F42B 5/145 102/385
8,253,085 B1 * 8/2012 Lichtenberg-Scanlan ..... F42B 10/20 244/3.27
9,702,673 B1 * 7/2017 Ginetto ..... F42B 10/14
9,989,338 B2 * 6/2018 Osdon ..... F42B 10/16
10,151,568 B2 12/2018 McAllister et al.
2004/0217227 A1 * 11/2004 Alculumbre ..... F42B 10/16 244/3.28
2012/0091256 A1 * 4/2012 Alculumbre ..... F42B 10/16 244/3.29
2012/0210901 A1 * 8/2012 Bender ..... F42B 10/16 244/3.29
2016/0349025 A1 * 12/2016 Osdon ..... F42B 10/16

FOREIGN PATENT DOCUMENTS

GB 2274904 A 8/1994

* cited by examiner

*Primary Examiner* — Assres H Woldemaryam
(74) *Attorney, Agent, or Firm* — Jordan IP Law, LLC

(57) ABSTRACT

A fin deployment system for a projectile positioned in a chamber, the fin deployment system including a non-rotatable hinge pin shaft, a fin member, and a unidirectional ratchet collar member. The non-rotatable hinge pin shaft, which is coupled to the shell, defines a helically-oriented pathway. The fin member has a fin lug that couples the fin member on the hinge pin shaft for simultaneous axial and rotational movement along the helically-oriented pathway to a deployed position at an aft region of the projectile. Such movement is induced at least partially by application of a centripetal load and aerodynamic load as the projectile rotates upon launch from a chamber. The unidirectional ratchet collar member is disposed on the hinge pin shaft for unidirectional axial movement and radial expansion induced by the simultaneous axial and rotational movement of the fin member that retains the fin member in the deployed position.

20 Claims, 11 Drawing Sheets

FIN DEPLOYMENT SYSTEM FOR A PROJECTILE, PROJECTILE, AND METHOD OF DEPLOYING A FIN ON A PROJECTILE

GOVERNMENT LICENSE RIGHTS

This invention was made with Government support under DOTC-19-01-INIT0543 awarded by Department of Defense. The government has certain rights in this invention.

FIELD

One or more embodiments relate generally to a fin deployment system for a projectile that optimizes deployment of a fin to guide and stabilize a projectile that is launched from a chamber of a launch platform.

BACKGROUND

Fins are generally used to stabilize the flight trajectory of gun-launched guided projectiles. For a full caliber projectile, the fins must be stowed during gun launch for deployment after exiting the chamber of the gun.

In existing projectiles launch platforms, inconsistent deployment of the fins and inconsistent locking of the fins after exiting of the projectile from a chamber of the launcher causes instability of the projectile, and thus, compromises the aerodynamic performance of the projectile.

SUMMARY

In one or more example embodiments, a fin deployment system for a projectile may include one or more of the following: a non-rotatable hinge pin shaft that defines a pathway, a fin member, and a unidirectional ratchet collar member. The fin member has a fin lug that couples the fin member on the hinge pin shaft for simultaneous axial and rotational movement along the pathway to a deployed position at an aft region of the projectile. Such simultaneous axial and rotational movement is induced, at least partially, by application of a centripetal load and aerodynamic load as the projectile rotates upon launch from a chamber. The unidirectional ratchet collar member, which is to retain the fin member in the deployed position, is disposed on the hinge pin shaft for unidirectional axial movement and radial expansion induced by the simultaneous axial and rotational movement of the fin member.

In one or more example embodiments, a projectile includes a shell and a fin deployment system coupled to the shell. The fin deployment system includes one or more of a non-rotatable hinge pin shaft that defines a helically-oriented pathway, a fin member, and a unidirectional ratchet collar member. The fin member has a fin lug that couples the fin member on the hinge pin shaft for simultaneous axial and rotational movement along the helically-oriented pathway to a deployed position at an aft region of the projectile. Such simultaneous axial and rotational movement is induced, at least partially, by application of a centripetal load and aerodynamic load as the projectile rotates upon launch from a chamber. The unidirectional ratchet collar member, which is to retain the fin member in the deployed position, is disposed on the hinge pin shaft for unidirectional axial movement and radial expansion induced by the simultaneous axial and rotational movement of the fin member.

In one or more example embodiments, a method of deploying a fin of a projectile includes providing a projectile having a projectile body positioned in a chamber and a fin deployment system (as disclosed herein) coupled to the projectile body. The method then proceeds to a process block that includes discharging the projectile from the chamber to cause a simultaneous axial and rotational movement of the fin member along a helically-oriented pathway to the deployed position. The method then proceeds to a process block that includes retaining the fin member in the deployed position via the ratchet collar member.

The features, functions, and advantages that have been discussed can be achieved independently in various embodiments or may be combined in yet other embodiments further details of which can be seen with reference to the following description and drawings.

BRIEF DESCRIPTION OF DRAWINGS

The various advantages of the examples of the present disclosure will become apparent to one skilled in the art by reading the following specification and appended claims, and by referencing the following drawings, in which:

DESCRIPTION

A fin deployment system for a projectile, a projectile, and a method of deploying a fin of a projectile are provided to enhance the aerodynamic performance of a projectile discharged from a chamber of a launch platform. In particular, the fin deployment system set forth, described, and/or illustrated herein comprises a plurality of fin members, each respective fin member configured to rapidly translate from a stowed position into a deployed state or position as the projectile is discharged from the chamber of the launch platform. Each fin member is induced to simultaneous axial and rotational movement along a helically-oriented pathway defined by a non-rotatable hinge pin shaft by application at least partially, of a centripetal load and aerodynamic load as the projectile is discharged from the chamber of the launch platform.

A ratchet collar member coupled to the hinge pin shaft engages the fin member to retain the fin member in the deployed position, and thus, inhibits reverse axial movement by the fin member once in the deployed position. The fin deployment system comprises robust architecture that withstands the operational forces of a launch sequence, while also being compact to maximize projectile payload. The helically-oriented pathway defined by the hinge pin shaft positively guides the fin member while incrementally advancing the hinge pin shaft to the deployed position where it is retained therein by the ratchet member. This eliminates the effect of mechanism distortion and erratic loading on securing the fin member in the deployed position.

Figure 1:
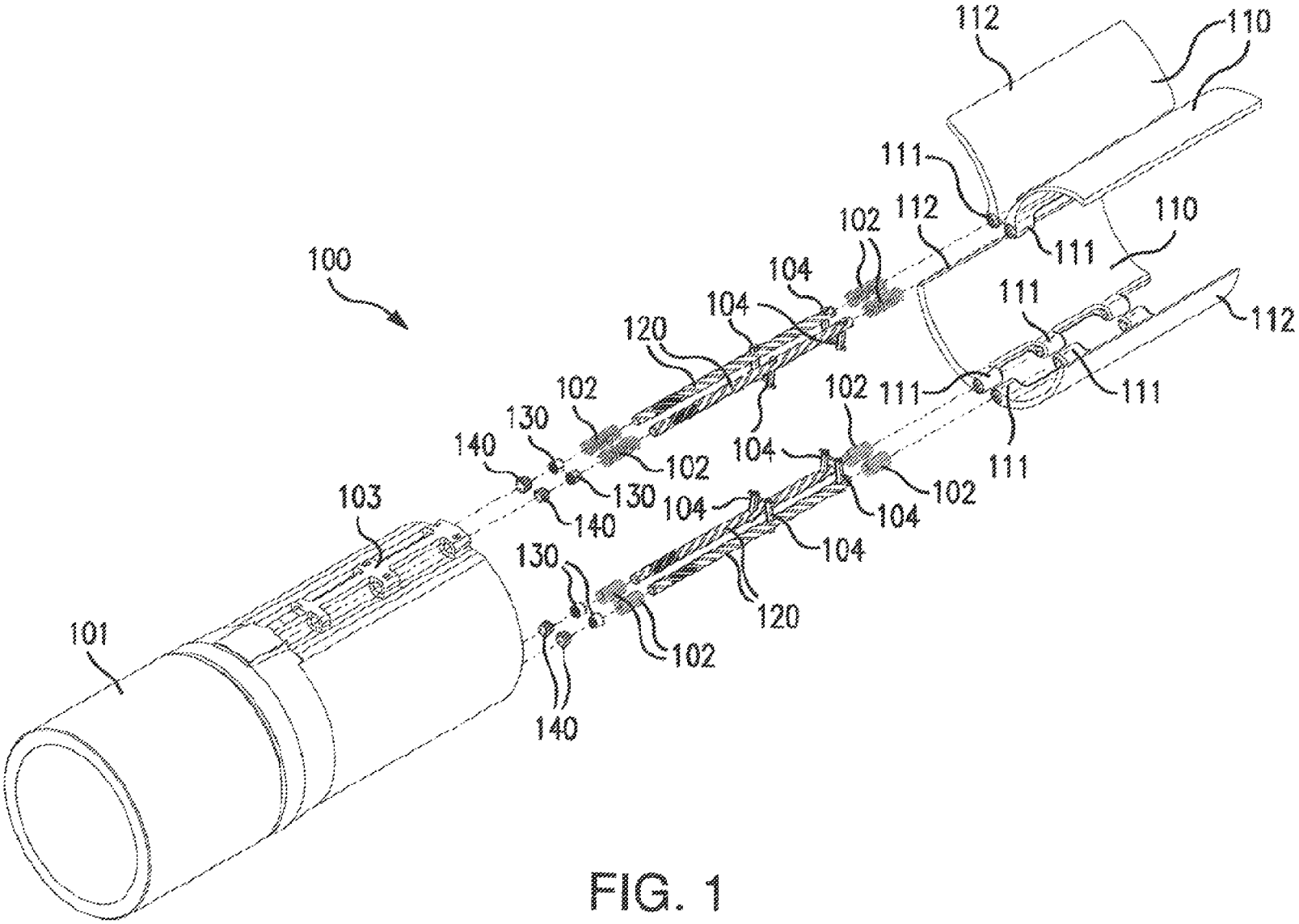
FIG. 1 illustrates a perspective, exploded view of an advantageous embodiment of a fin deployment system for a projectile.
Figure 3:
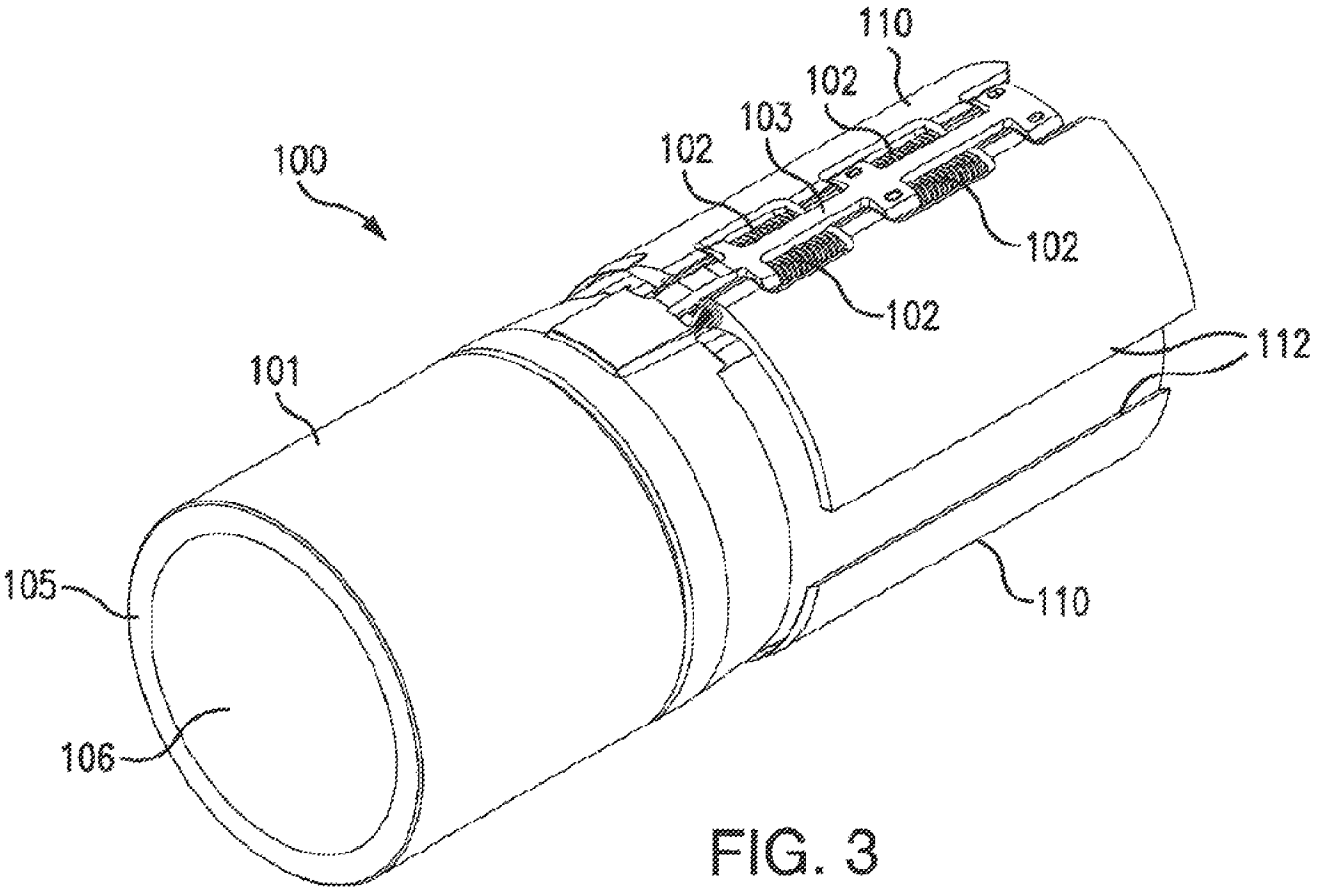
FIG. 3 illustrates a perspective view of the fin deployment system of FIG. 1, in a stowed position.
Figure 4:
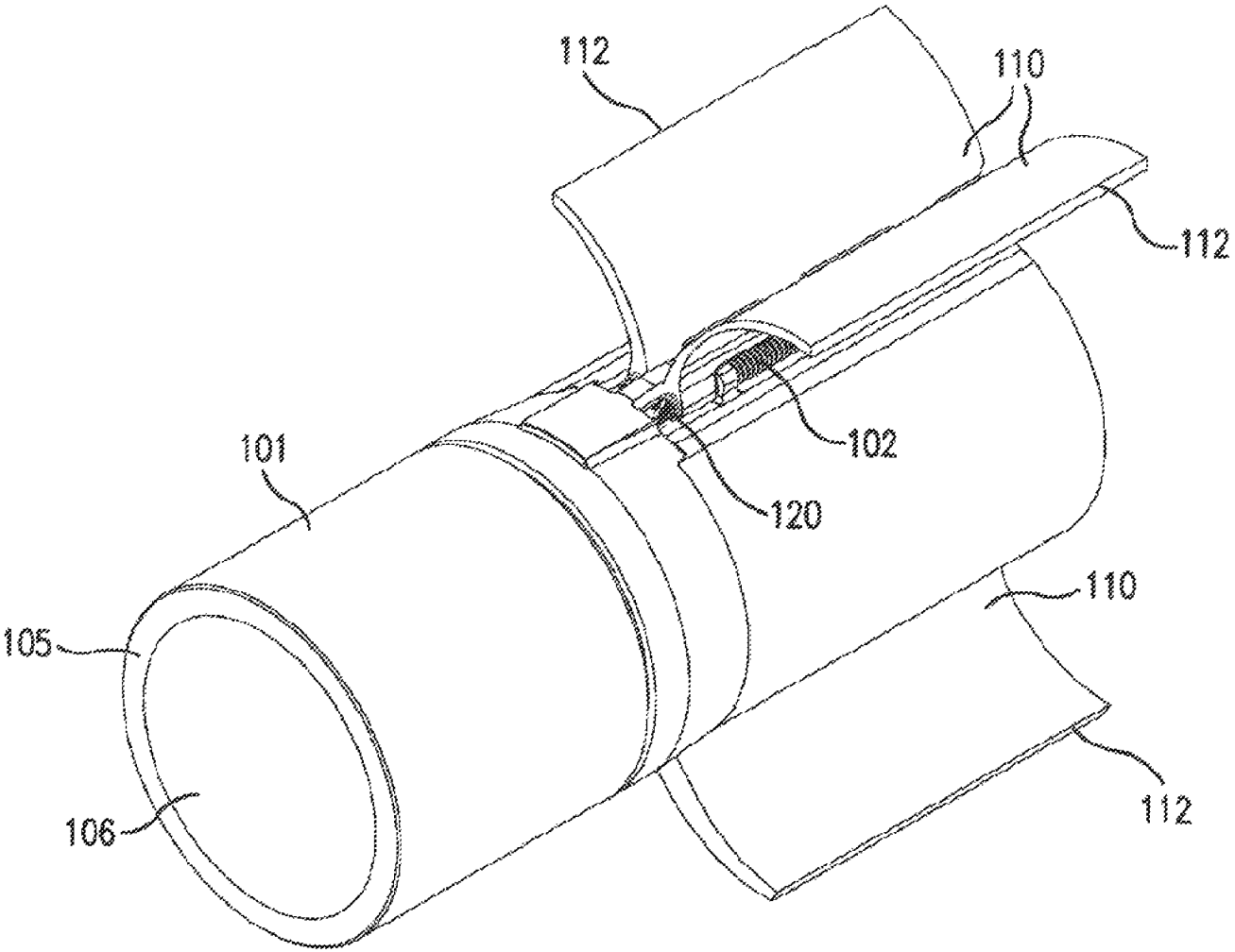
FIG. 4 illustrates a perspective view of the fin deployment system of FIG. 1, in a deployed position.
Figure 5:
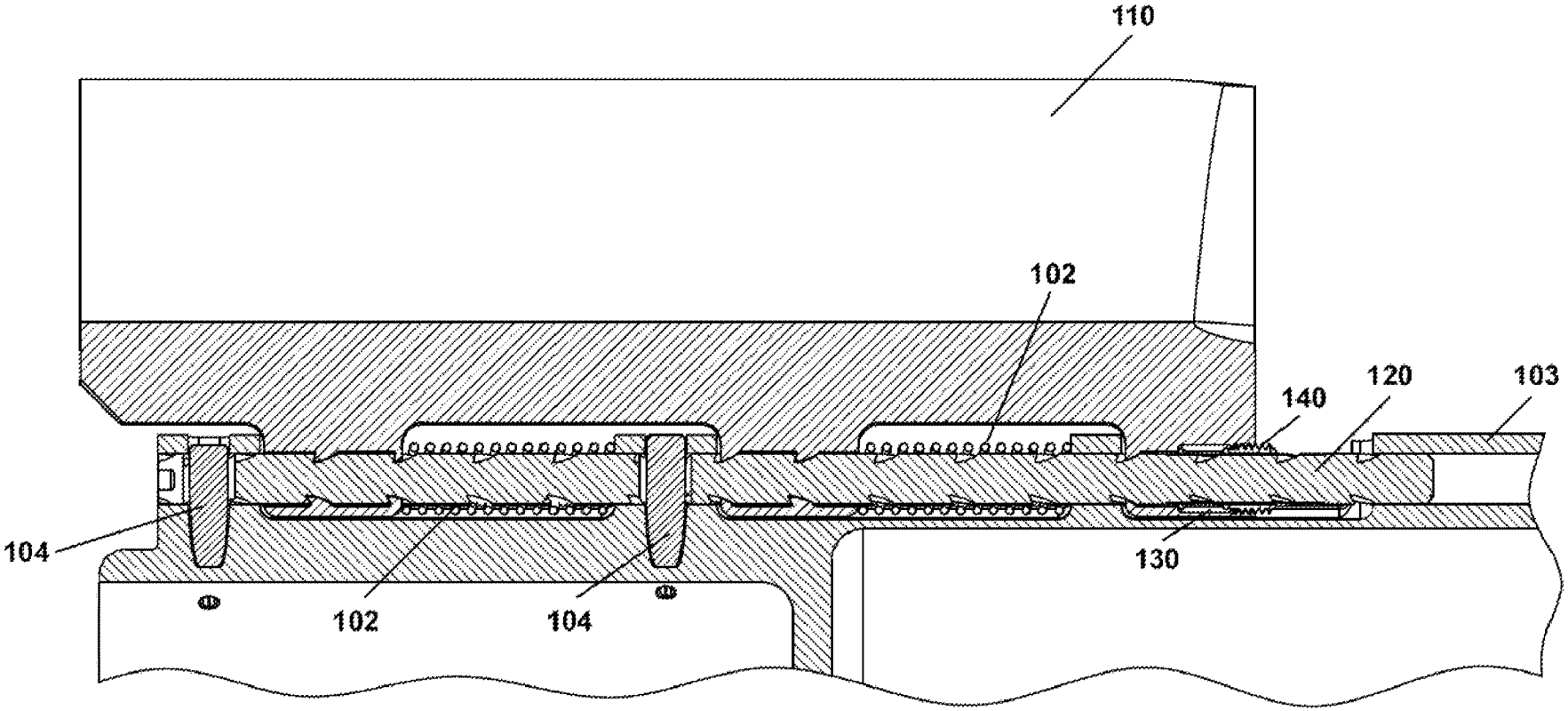
FIG. 5 illustrates a partial, side, sectional view of the fin deployment system of FIG. 1.
Figure 6:
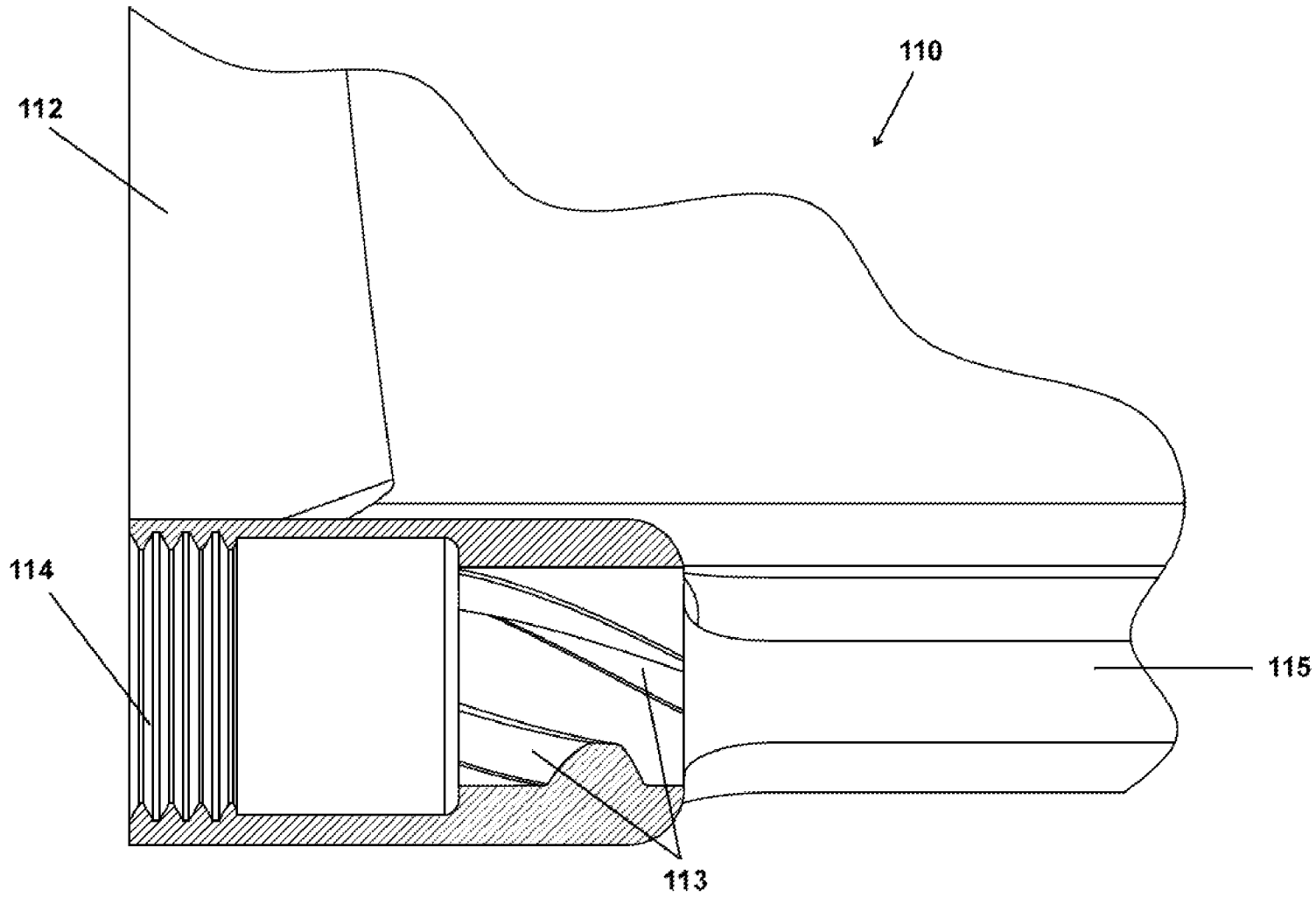
FIG. 6 illustrates a partial, side, sectional view of a fin member of the fin deployment system of FIG. 1.

In the illustrated example of FIG. 1, a fin deployment system 100 for a projectile. The fin deployment system 100 is configured for receipt in a chamber of a launch vehicle or platform, and comprises a casing or shell 101 which is coupled to the projectile, and a plurality of fin members 110 configured for movement from a stowed state or position (FIG. 3) to a deployed state or position (FIG. 4) at an aft region of the projectile upon launch of the projectile. A non-rotatable hinge pin shaft 120, suitable for use with each fin member 110, is coupled to the shell 101. The fin member 110 is coupled to an exterior surface of the shell 101 via the non-rotatable hinge pin shaft 120, which defines a helically-oriented pathway that facilitates the simultaneous axial and rotational movement of the fin member 110.

In addition centripetal loading and aerodynamic loading as the projectile is discharged from the chamber of the launch platform, one or more spring loads applied by spring members 102 induces the fin member 110 to simultaneous axial and rotational movement. The fin member 110 is engaged by a ratchet collar member 130 to retain the fin member 110 in the deployed position. A sleeve member 140, configured for concurrent axial and rotational movement with the fin member 110, induces unidirectional axial movement of the ratchet collar member 130 during the translation of the fin member 110 into the deployed position.

In one or more exemplary embodiments, the shell 101 comprises a shell body 105 defining a volume 106 which contains the payload. A bracket 103 is arranged on opposite exterior surfaces of the shell 101 to facilitate the coupling of a pair of fin members 110 to the shell 101. The non-rotatable hinge pin shaft 120 is received in a bore of a bracket 103, and coupled thereto via one or more connector members 104. In one or more exemplary embodiments, the shell body 105 is fabricated using a high-strength material capable of withstanding high launch loads. An exemplary material for fabricating the shell body 105 includes, but is not limited to, alloy steels. Such an example material disclosed herein, however, is not limited thereto. Thus, this disclosure contemplates fabricating the shell body 105 using any suitable material that falls within the spirit and scope of the principles of this disclosure set forth herein.

In one or more exemplary embodiments, each fin member 110 comprises a fin body 112 having an arcuate shape that, when in the stowed position, wraps around and engages the exterior circumferential surface of the shell 101. In one or more exemplary embodiments, the fin body 112 is fabricated using a lightweight material capable of withstanding high aerodynamic loads. An exemplary material for fabricating the fin body 112 includes, but is not limited to, titanium. Such an example material disclosed herein, however, is not limited thereto. Thus, this disclosure contemplates fabricating the fin body 112 using any suitable material that falls within the spirit and scope of the principles of this disclosure set forth herein. For example, depending upon the application of the projectile, each fin member 110 may be fabricated from a suitable material that comprises one or more of a polymer material, a composite material, etc.

The fin member 110 further comprises a plurality of fin lugs 111 that rotatably couples the fin member 110 to the non-rotatable hinge pin shaft 120. Each fin lug 111 comprises an axial bore 115 through which the non-rotatable hinge pin shaft 120 is received. Each fin lug 111 has a plurality of helical internal threads 113 having a helical orientation that is extends in an axial direction of the non-rotatable hinge pin shaft 120. The helical internal threads 113 are arranged at a first axial region thereof that engage the helical external grooves 121 of the non-rotatable hinge pin shaft 120 to facilitate the simultaneous axial and rotational movement of the fin member 110 along the non-rotatable hinge pin shaft 120 to the deployed position. One of the fin lugs 111, arranged at a fore end of the fin member 110, further comprises a plurality of concentric internal threads 114 at a second axial region thereof to facilitate a coupling of the fin member 110 to the sleeve member 140. As used herein, the helical orientation is relative to the longitudinal axis of the fin lugs 111.

Figure 2:
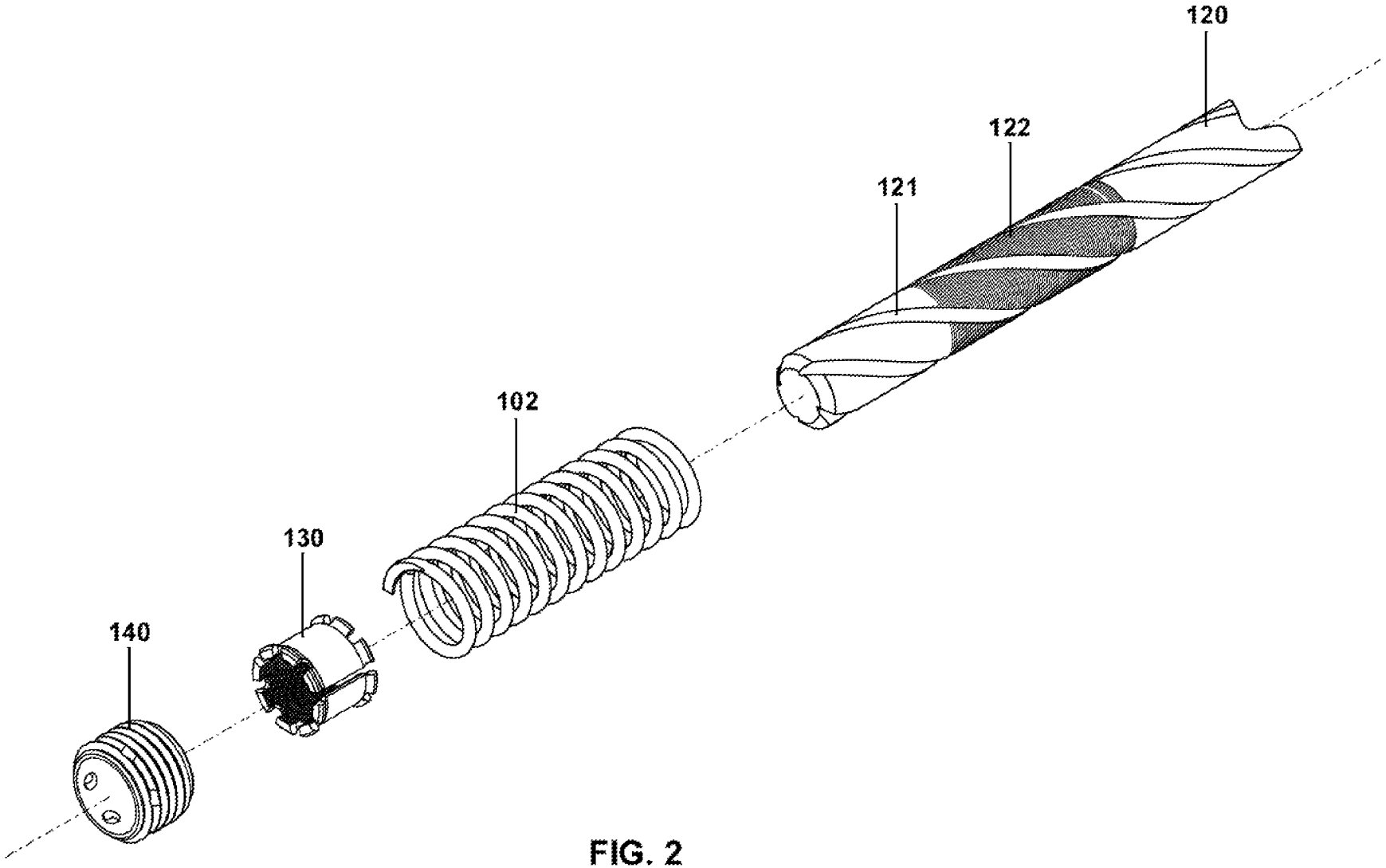
FIG. 2 illustrates a partial perspective, exploded view of a hinge pin shaft, a spring member, a ratchet collar member and a sleeve member of the fin deployment system of FIG. 1.
Figure 8:
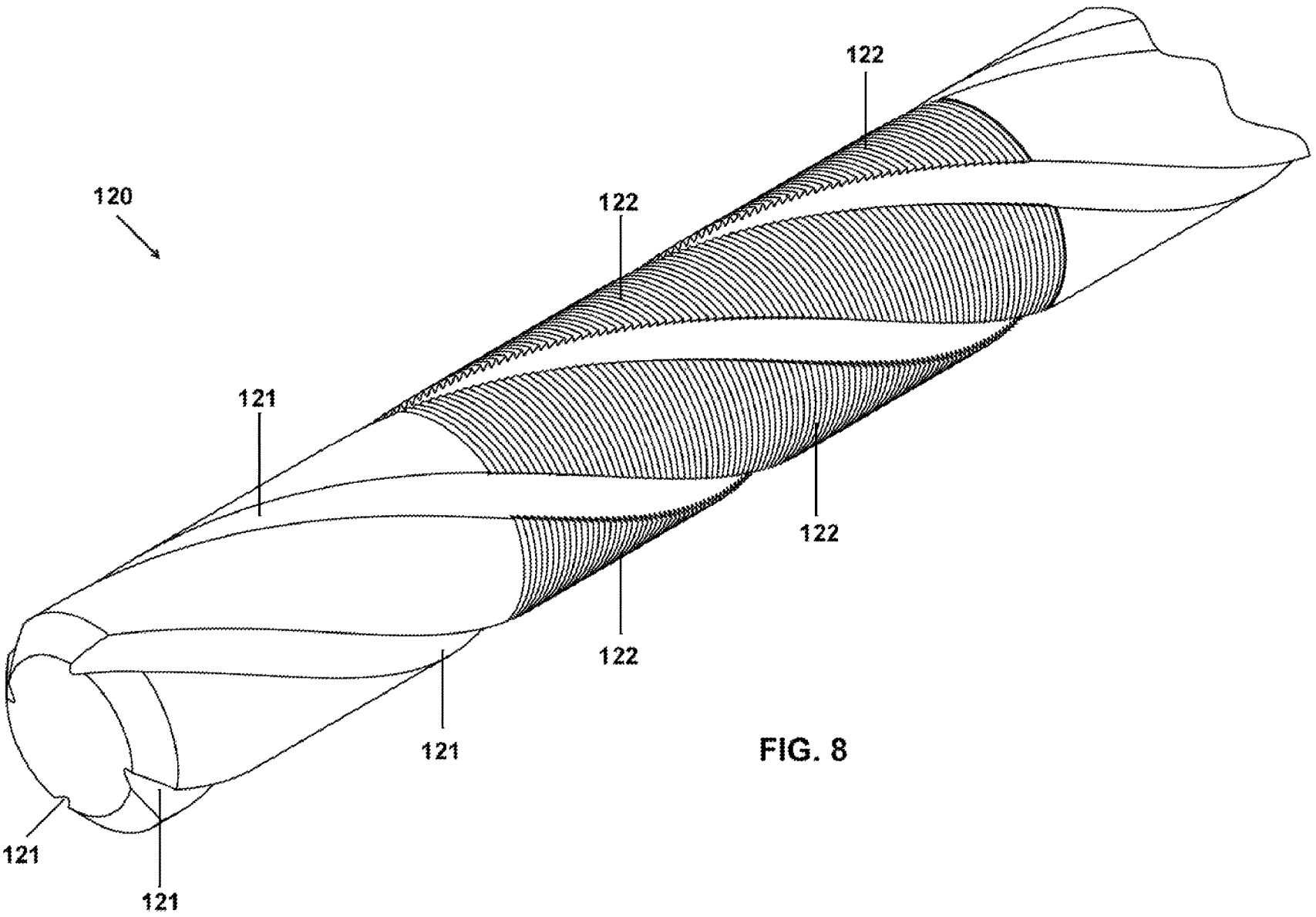
FIG. 8 illustrates a partial perspective view of a hinge pin shaft of the fin deployment system of FIG. 1.

In the illustrated exemplary embodiment of FIGS. 2 and 8, the non-rotatable hinge pin shaft 120 is coupled to the fin member 110 to facilitate the simultaneous axial and rotational movement of the fin member 110 induced by the one or more spring loads, aerodynamic loads, and centripetal loads during discharge of the projectile from the chamber of the launch platform. The non-rotatable hinge pin shaft 120 comprises a generally cylindrical body. In one or more exemplary embodiments, the non-rotatable hinge pin shaft 120 is fabricated using a high-strength material capable of withstanding high dynamic loads. An exemplary material for fabricating the non-rotatable hinge pin shaft 120 includes, but is not limited to, alloy steels. Such an example material disclosed herein, however, is not limited thereto. Thus, this disclosure contemplates fabricating the non-rotatable hinge pin shaft 120 using any suitable material that falls within the spirit and scope of the principles of this disclosure set forth herein.

The exterior surface of the non-rotatable hinge pin shaft 120 has one or more helical external grooves 121 having a helical orientation that extends in an axial direction relative to the non-rotatable hinge pin shaft 120. The one or more helical external grooves 121 are configured to be engaged by the one or more helical internal threads 113 of the fin lug 111 to facilitate the simultaneous axial and rotational movement of the fin member 110. The helical external grooves 121 define the helically-oriented pathway upon which the fin member 110 moves simultaneously in an axial and rotational manner of to the deployed position. The exterior surface of the generally cylindrical body also includes a plurality of external threads 122 respectively extending at least partially along a longitudinal length of the non-rotatable hinge pin shaft 120. In accordance with one or more embodiments, the external threads 122 comprise buttress threads. Embodiments, however, are not limited thereto, and thus, this disclosure contemplates the external threads 122 comprising suitable architecture that falls within the spirit and scope of the principles of this disclosure set forth herein.

Figure 7:
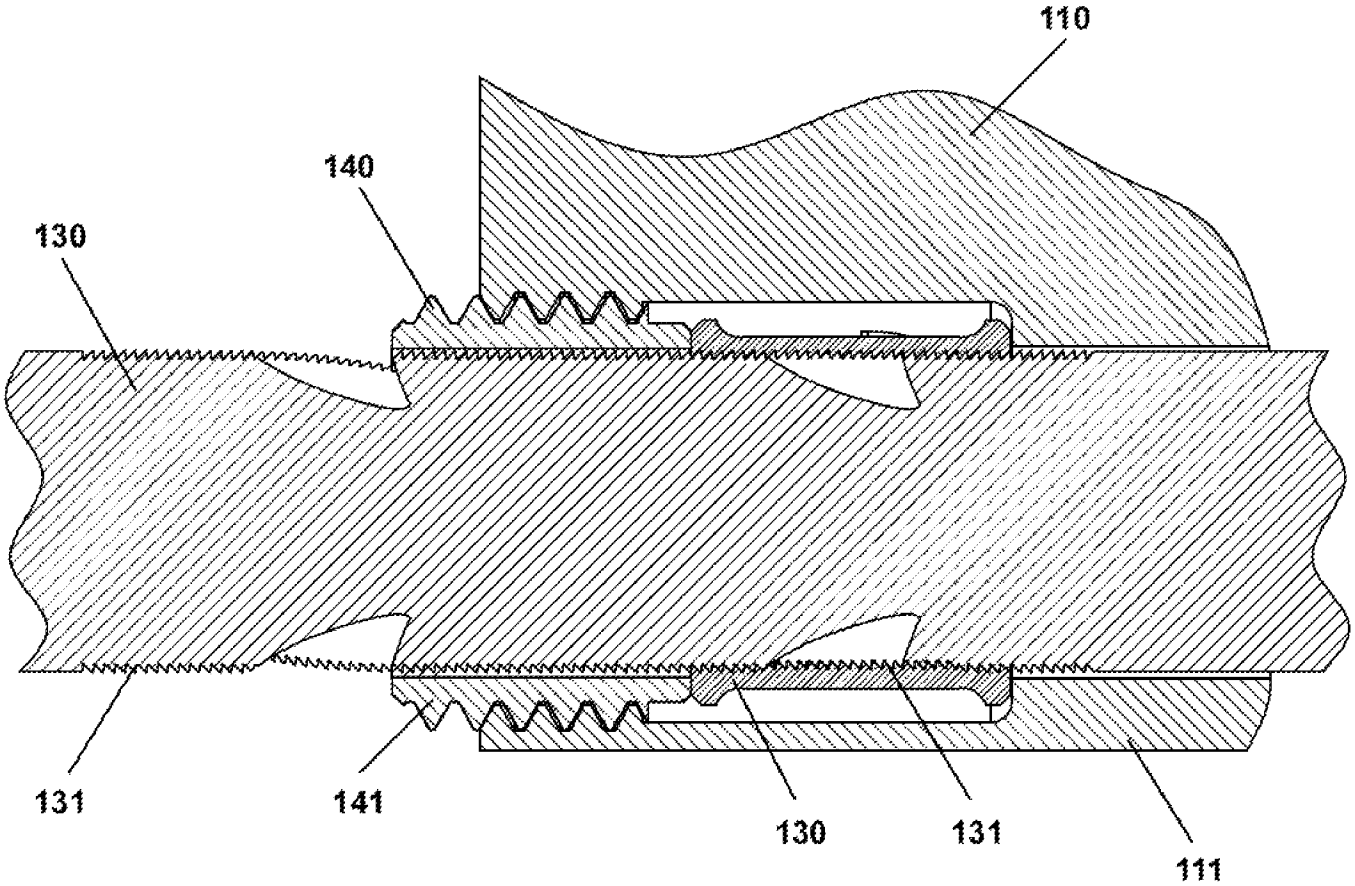
FIG. 7 illustrates a partial, side, sectional view of the fin deployment system of FIG. 1.
Figure 9:
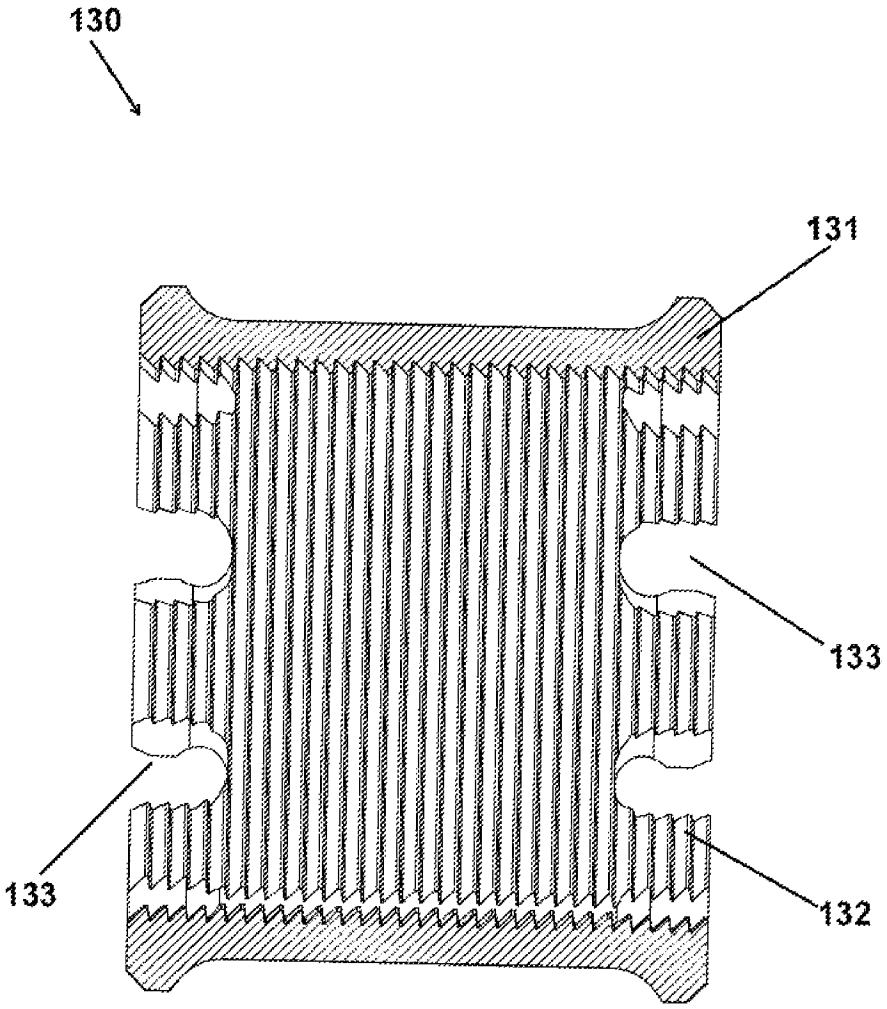
FIG. 9 illustrates a partial perspective view of a ratchet collar member of the fin deployment system of FIG. 1.

In the illustrated exemplary embodiment of FIGS. 7 and 9, the ratchet collar member 130 comprises an axially-split ratchet collar body 131 having a plurality of internal threads 132. In one or more exemplary embodiments, the axially-split ratchet collar body 131 is fabricated using a resilient material having a high yield strength. An exemplary material for fabricating the axially-split ratchet collar body 131 includes, but is not limited to, spring steels. Such an example material disclosed herein, however, is not limited thereto. Thus, this disclosure contemplates fabricating the axially-split ratchet collar body 131 using any suitable material that falls within the spirit and scope of the principles of this disclosure set forth herein.

In one or more exemplary embodiments, an exemplary minimum actuation force value to induce the ratcheting movement of the axially-split ratchet collar body 131 in the aft direction is approximately 150 lbf. An exemplary maximum force value that the axially-split ratchet collar body 131 can withstand in the forward direction while maintaining the position on the non-rotatable hinge pin shaft 120 that retains the fin member 110 in the deployed position is approximately 3700 lbf.

The internal threads 132 are configured to engage the external threads 122 of the hinge pin shaft 120 to facilitate the unidirectional axial movement of the ratchet collar member 130 as the fin member 110 translates to the deployed position. In accordance with one or more embodiments, the internal threads 132 comprise buttress threads. Embodiments, however, are not limited thereto, and thus, this disclosure contemplates the internal threads 132 comprising suitable architecture that falls within the spirit and scope of the principles of this disclosure set forth herein. The overall number of internal threads 132 is specific to the application of the projectile.

The axially-split ratchet collar body 131 facilitates the iterative radial expansion of the ratchet collar member 130 as the ratchet collar member 130 moves axially in an aft direction due the engagement of the internal threads 132 with the external threads 122 of the non-rotatable hinge pin shaft 120. Such iterative radial expansion is concurrent with the translation of the fin member 110 into the deployed position. In accordance with one or more embodiments, the ratchet collar member 130 is caused to move unidirectionally due to application of a force by the sleeve member 140.

The axial movement of the fin member 110 along the non-rotatable hinge pin shaft 120 induces a unidirectional ratcheting axial movement of the ratchet collar member 130 in the aft direction as the fin member 110 translates into the deployed position. The ratchet collar member 130 engages a radial chamfer of the non-rotatable hinge pin shaft 120 that induces the radially expansion of the ratchet collar member 130 as the internal threads 132 engage the adjacent external threads 122 of the non-rotatable hinge pin shaft 120. The engagement also establishes the unidirectional ratcheting axial movement of the ratchet collar member 130 in an aft-direction on the non-rotatable hinge pin shaft 120 as the fin member 110 translates into the deployed position. Once the fin member 110 translates into the deployed position, the ratchet collar member 130 locks or otherwise retains the fin member 110 in the deployed position in a manner that inhibits reverse axial movement by the fin member 110.

Distal axial ends of the axially-split ratchet collar body 131 have a plurality of radially spaced apart notches 133 to minimize the actuation force to radially expand the axially-split ratchet collar body 131 during the unidirectional ratcheting axial movement of the ratchet collar member 130. The notches 133 reduce the overall stiffness of the axially-split ratchet collar body 131, which minimizes the actuation force required to radially expand the ratchet collar member 130 and advance the ratchet collar member 130 axially along the non-rotatable hinge pin shaft 120.

The sleeve member 140 comprises a plurality of external concentric threads 141 that engage the concentric internal threads 114 of the fin lug 111 to facilitate a threaded coupling to the fin member 110. The sleeve member 140 also facilitates retainment of the ratchet collar member 130 in the axial bore 115 of the fin lug 111. The sleeve member 140 has concurrent axial and rotational movement with the fin member 110 that induces the unidirectional ratcheting axial movement of the ratchet collar member 130 until the fin member 110 translates into the deployed position. In accordance with one or more embodiments, the frictional force at the interface between the ratchet collar member 130 and the sleeve member 140 is less than the frictional force at the coupling interface between the non-rotatable hinge pin shaft 120 and the ratchet collar member 130, thus inducing the unidirectional axial movement of the ratchet collar member 130. Alternatively, the frictional force at the interface between the ratchet collar member 130 and the sleeve member 140 is greater than the frictional force at the coupling interface between the non-rotatable hinge pin shaft 120 and the ratchet collar member 130, thus inducing a combination of unidirectional ratcheting axial movement and rotation of the ratchet collar member 130.

In one or more exemplary embodiments, the sleeve member 140 is fabricated using traditional machining processes (e.g., Computerized Numerical Control lathe). An exemplary material for fabricating the sleeve member 140 includes, but is not limited to, precipitation-hardened stainless steel. Such an example material disclosed herein, however, is not limited thereto. Thus, this disclosure contemplates fabricating the sleeve member 140 using any suitable material that falls within the spirit and scope of the principles of this disclosure set forth herein.

Figure 10:
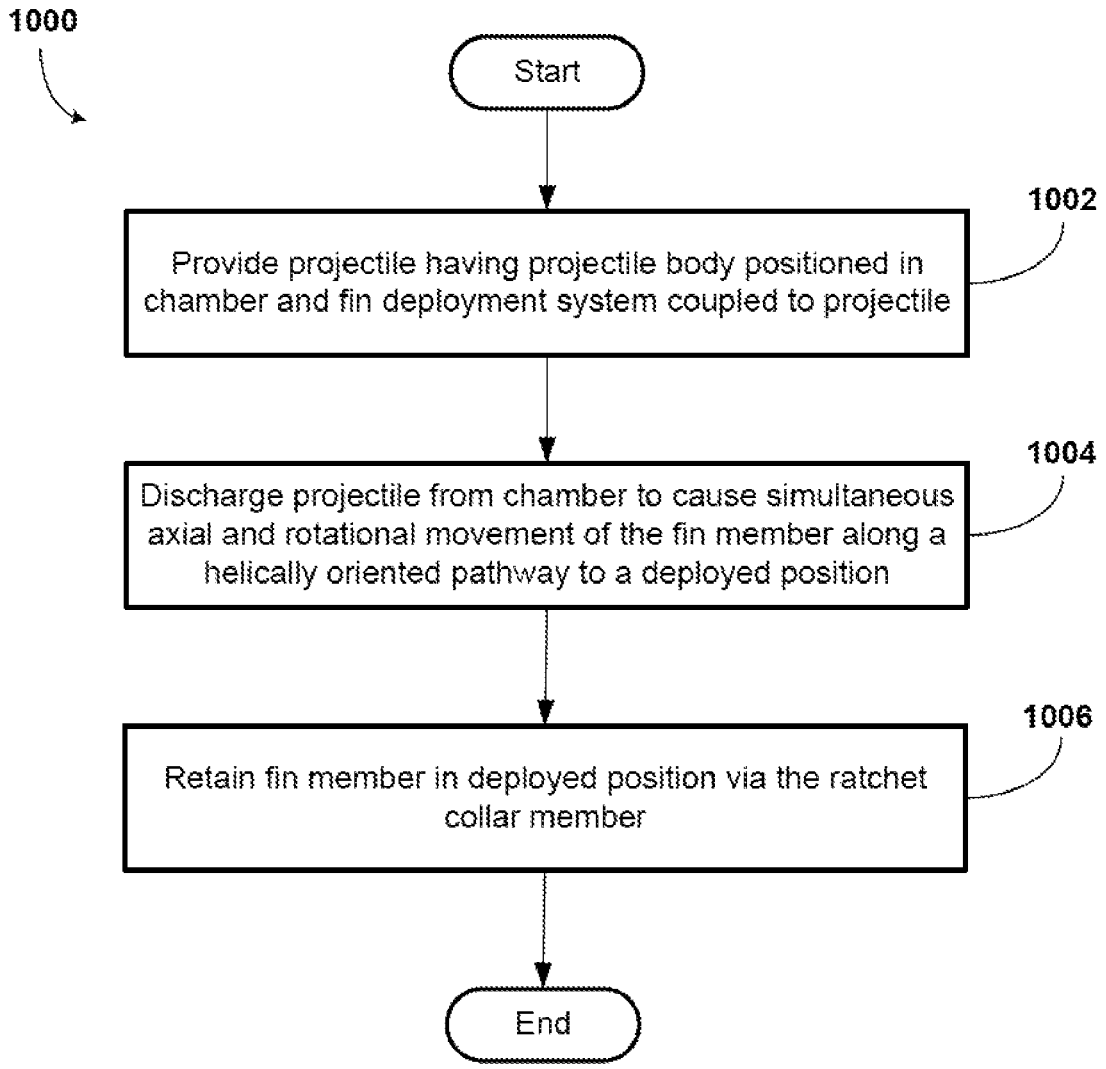
FIGS. 10 and 11 respectively illustrate advantageous embodiments of a method of deploying a fin on a projectile.
Figure 11:
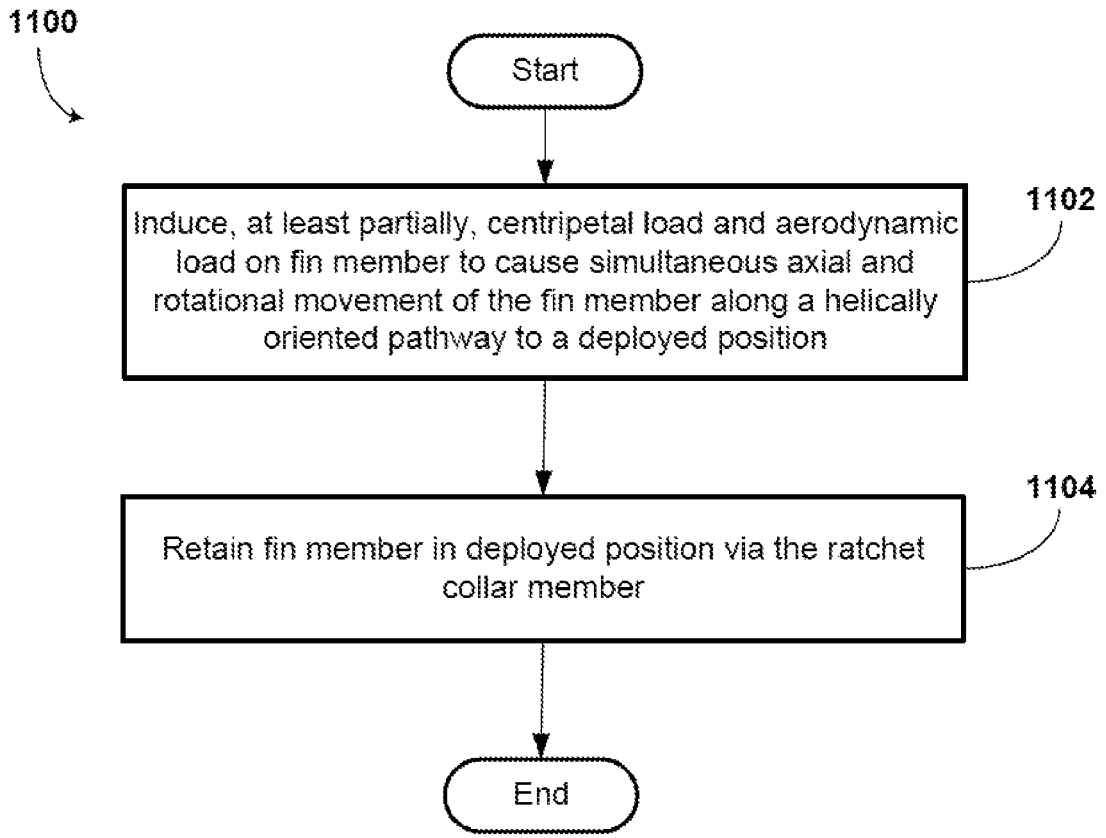

The illustrated embodiment of FIGS. 10 and 11 respectively set forth a flowchart of methods 1000, 1100 of deploying a fin on a projectile.

In the illustrated example of FIG. 10, illustrated process block 1002 includes providing a projectile having a projectile body positioned in a chamber and a fin deployment system coupled to the projectile body.

The method 1000 then proceeds to illustrated process block 1004, which includes discharging the projectile from the chamber to cause the simultaneous axial and rotational movement of the fin member along a helically-oriented pathway to a deployed position. In the illustrated embodiment, the axial and rotational movement of the fin member is induced, at least partially, by a centripetal load and an aerodynamic load on the fin member.

The method 1000 then proceeds to illustrated process block 1006, which includes retaining the fin member in the deployed position via the ratchet collar member.

The method 1000 may terminate or end after execution of process block 1006.

In the illustrated embodiment of FIG. 11, illustrated process block 1102 includes inducing, at least partially, a centripetal load and an aerodynamic load on the fin member to cause the simultaneous axial and rotational movement of the fin member along a helically-oriented pathway to a deployed position. In the illustrated embodiment, inducing the centripetal load and an aerodynamic load on the fin member comprises discharging the projectile from a chamber of a launch platform.

The method 1100 then proceeds to illustrated process block 1104, which includes retaining the fin member in a deployed position at an aft region of the projectile.

The method 1100 may terminate or end after execution of process block 1104.

The terms "coupled," "attached," or "connected" used herein is to refer to any type of relationship, direct or indirect, between the components in question, and is to apply to electrical, mechanical, fluid, optical, electromagnetic, electromechanical or other connections. Additionally, the terms "first," "second," etc. are used herein only to facilitate discussion, and carry no particular temporal or chronological significance unless otherwise indicated. The terms "cause" or "causing" means to make, force, compel, direct, command, instruct, and/or enable an event or action to occur or at least be in a state where such event or action is to occur, either in a direct or indirect manner.

Those skilled in the art will appreciate from the foregoing description that the broad techniques of the one or more embodiments of the present disclosure is to be implemented in a variety of forms. Therefore, while the present disclosure describes matters in connection with particular embodiments thereof, the true scope of the embodiments of the present disclosure should not be so limited since other modifications will become apparent to the skilled practitioner upon a study of the drawings, specification, and following claims.

What is claimed is:

1. A fin deployment system on a projectile positioned in a chamber, the fin deployment system comprising: a non-rotatable hinge pin shaft defining a helically-oriented pathway, the non-rotatable hinge pin shaft coupled to a shell of the projectile; a fin member having a fin lug that couples the fin member on the non-rotatable hinge pin shaft for simultaneous axial and rotational movement along the helically-oriented pathway to a deployed position at an aft region of the projectile which is induced at least partially by application of a centripetal load and aerodynamic load as the projectile rotates upon launch from a chamber, and a unidirectional ratchet collar member, disposed on the non-rotatable hinge pin shaft for unidirectional axial movement and radial expansion induced by the simultaneous axial and rotational movement of the fin member that retains the fin member in the deployed position.

2. The system of claim 1, wherein the non-rotatable hinge pin shaft comprises one or more helical external grooves defining the helically-oriented pathway, and a plurality of external buttress threads respectively extending along a longitudinal length of the non-rotatable hinge pin shaft.

3. The system of claim 2, wherein the fin lug comprises one or more helical internal threads that mate with the one or more helical external grooves to facilitate the simultaneous axial and rotational movement of the fin member.

4. The system of claim 2, wherein the unidirectional ratchet collar member comprises a split-collar body having one or more internal buttress threads that engage the plurality of external buttress threads to facilitate a unidirectional axial movement and radial expansion of the unidirectional ratchet collar member relative to the non-rotatable hinge pin shaft.

5. The system of claim 4, wherein the axial movement of the fin member causes the one or more internal buttress threads to engage the plurality of external buttress threads of the non-rotatable hinge pin shaft causing the unidirectional ratchet collar member to radially expand and establish the unidirectional axial movement of the unidirectional ratchet collar member in an aft-direction on the non-rotatable hinge pin shaft.

6. The system of claim 4, further comprising a sleeve member axially received in a threaded bore of the fin lug for concurrent axial and rotational movement with the fin member that induces the unidirectional axial movement of the unidirectional ratchet collar member.

7. The system of claim 1, further comprising a spring member to apply a spring force which induces the simultaneous axial and rotational movement of the fin member as the projectile rotates upon launch from the chamber.

8. A projectile, comprising:

a shell; and a fin deployment system including:

a non-rotatable hinge pin shaft defining a helically-oriented pathway, the non-rotatable hinge pin shaft coupled to the shell;

a fin member having a fin lug that couples the fin member on the non-rotatable hinge pin shaft for simultaneous axial and rotational movement along the helically-oriented pathway to a deployed position at an aft region of the projectile which is induced at least partially by application of a centripetal load and an aerodynamic load as the projectile rotates upon launch from a chamber; and a unidirectional ratchet collar member, disposed on the non-rotatable hinge pin shaft for axial movement and radial expansion induced by the simultaneous axial and rotational movement of the fin member that retains the fin member in the deployed position.

9. The projectile of claim 8, wherein the non-rotatable hinge pin shaft comprises one or more helical external grooves defining the helically-oriented pathway, and a plurality of external buttress threads respectively extending along a longitudinal length of the non-rotatable hinge pin shaft.

10. The projectile of claim 9, wherein the fin lug comprises one or more helical internal threads that mate with the one or more helical external grooves to facilitate the simultaneous axial and rotational movement of the fin member.

11. The projectile of claim 9, wherein the unidirectional ratchet collar member comprises a split-collar body having one or more internal buttress threads that engage the plurality of external buttress threads to facilitate a unidirectional axial movement and radial expansion of the unidirectional ratchet collar member relative to the non-rotatable hinge pin shaft.

12. The projectile of claim 11, wherein the axial movement of the fin member causes the one or more internal buttress threads to engage the plurality of external buttress threads of the non-rotatable hinge pin shaft causing the unidirectional ratchet collar member to radially expand and establish the unidirectional axial movement of the unidirectional ratchet collar member in an aft-direction on the non-rotatable hinge pin shaft.

13. The projectile of claim 11, further comprising a sleeve member axially received in a threaded bore of the fin lug for concurrent axial and rotational movement with the fin member that induces the unidirectional axial movement of the unidirectional ratchet collar member.

14. The projectile of claim 8, further comprising a spring member to apply a spring force which induces the simultaneous axial and rotational movement of the fin member as the projectile rotates upon launch from the chamber.

15. A method of deploying a fin on a projectile, the method comprising:

providing the projectile of claim 8;

discharging the projectile from the chamber to cause the simultaneous axial and rotational movement of the fin member along the helically-oriented pathway to the deployed position; and retaining the fin member in the deployed position via the unidirectional ratchet collar member.

16. The method of claim 15, wherein the non-rotatable hinge pin shaft comprises one or more helical external grooves defining the helically-oriented pathway, and a plurality of external buttress threads respectively extending along a longitudinal length of the non-rotatable hinge pin shaft.

17. The method of claim 16, wherein the fin lug comprises one or more helical internal threads that mate with the one or more helical external grooves to facilitate the simultaneous axial and rotational movement of the fin member.

18. The method of claim 16, wherein the unidirectional ratchet collar member comprises a split-collar body having one or more internal buttress threads that engage the plurality of external buttress threads to facilitate a unidirectional axial movement and radial expansion of the unidirectional ratchet collar member relative to the non-rotatable hinge pin shaft.

19. The method of claim 18, wherein the axial movement of the fin member causes the one or more internal buttress threads to engage the plurality of external buttress threads of the non-rotatable hinge pin shaft causing the unidirectional ratchet collar member to radially expand and establish the unidirectional axial movement of the unidirectional ratchet collar member in an aft-direction on the non-rotatable hinge pin shaft.

20. The method of claim 18, further comprising inducing the unidirectional axial movement of the unidirectional ratchet collar member via a sleeve member axially received in a threaded bore of the fin lug for concurrent axial and rotational movement with the fin member.

* * * * *